US005263921A

United States Patent [19]

Gingras

[11] Patent Number: 5,263,921

[45] Date of Patent: Nov. 23, 1993

[54] CENTRIFUGAL SEPARATOR FOR SEPARATING SOLIDS AND RECYCLABLE FLUIDS FROM A FLUID MIXTURE

[76] Inventor: Earl Gingras, R.R. #3, Eckville, Alberta, Canada, T0M 0X0

[21] Appl. No.: 3,432

[22] Filed: Jan. 12, 1993

[30] Foreign Application Priority Data

Aug. 21, 1992 [CA] Canada ..... 2076611

[51] Int. Cl.[5] ..... B04B 11/00

[52] U.S. Cl. ..... 494/29; 494/41; 494/56; 494/60

[58] Field of Search ..... 494/23, 27, 28, 29, 494/38, 39, 41, 56, 60; 210/781, 782, 512.1

[56] References Cited

U.S. PATENT DOCUMENTS

| | | | |
|---|---|---|---|
| 1,897,240 | 2/1933 | Dahlgren . | |
| 2,234,921 | 3/1941 | Webb | 261/83 |
| 2,244,034 | 6/1941 | Van Riel | 233/14 |
| 2,283,457 | 5/1942 | Pecker | 210/69 |
| 2,578,485 | 12/1951 | Nyrop | 233/15 |
| 3,559,879 | 2/1971 | Bechard | 233/11 |
| 3,791,575 | 2/1974 | Kartinen et al. | 233/19 A |
| 3,810,347 | 5/1974 | Kartinen | 55/45 |
| 3,844,738 | 10/1974 | Reinhoudt et al. | 55/36 |
| 3,960,319 | 6/1976 | Brown et al. | 233/19 R |
| 3,967,778 | 7/1976 | Hunwick | 494/29 |
| 4,036,427 | 7/1977 | Erickson et al. | 233/10 |
| 4,044,943 | 8/1977 | Brown et al. | 233/19 A |
| 4,108,354 | 8/1978 | Madsen | 233/30 |
| 4,190,194 | 2/1980 | Amero | 233/7 |
| 4,283,005 | 8/1981 | Erickson | 233/47 A |
| 4,362,620 | 12/1982 | High | 210/378 |
| 4,512,759 | 4/1985 | Alink | 494/60 |
| 4,617,010 | 10/1986 | Epper et al. | 494/52 |
| 4,626,237 | 12/1986 | Galloway, Jr. | 494/37 |
| 4,806,019 | 2/1989 | Lutwick | 494/29 |
| 5,182,020 | 1/1993 | Grimwood | 210/781 |

FOREIGN PATENT DOCUMENTS

| | | | |
|---|---|---|---|
| 728533 | 2/1966 | Canada | 233/16 |
| 1098484 | 3/1981 | Canada | 204/107 |
| 2317001 | 11/1973 | Fed. Rep. of Germany . | |

*Primary Examiner*—Robert W. Jenkins

*Attorney, Agent, or Firm*—Davis, Bujold & Streck

[57] ABSTRACT

A centrifugal separator in which a wash fluid zone is formed within the confines of an annular weir, with excess wash fluids passing via a spillway to an excess wash fluid outlet. Recyclable fluids are forced into a wash fluid/recyclable fluid interface on top of the wash fluid zone by centrifugal force with recyclable fluids being skimmed from the wash fluid/recyclable fluid interface through a recyclable fluid outlet. Solids are propelled by centrifugal force outwardly toward interior sidewalls and washed down sloped interior sidewalls toward a solids outlet by wash fluids fed continuously in through a wash fluids inlet. A rotating shaft is provided having a plurality of arms which extend to immediately adjacent the solids outlet. The arms have paddle shaped extremities. Upon rotation of the shaft the paddle shaped extremities are brought into communication with any solids accumulated immediately adjacent the solids outlet thereby preventing a build up of solids which could potentially cause a blockage of the solids outlet and propelling solids mixed with wash fluid out the solids outlet.

3 Claims, 2 Drawing Sheets

CENTRIFUGAL SEPARATOR FOR SEPARATING SOLIDS AND RECYCLABLE FLUIDS FROM A FLUID MIXTURE

BACKGROUND OF THE INVENTION

Two phase and three phase centrifugal separators are often used to separate fluids having differing densities; such as oil, water and gas. Centrifugal separators do not operate well when processing fluid mixtures that have a high solids content. Solids rapidly accumulate to block orifices. In addition, solids accumulations create an imbalance within the centrifugal separator. A number of means have been used in prior art devices to address this problem of solids accumulation. In U.S. Pat. No. 4,036,427 a stationary stirrer vane assembly is used. In U.S. Pat. Nos. 2,766,930 and 4,283,005 spray nozzles are positioned within the interior of the separator. In U.S. Pat. Nos. 4,190,194 and 2,283,457 screw-type of internal conveyor/scrapers are used.

SUMMARY OF THE INVENTION

What is required is a centrifugal separator which is better suited for use with fluid mixtures having a high solids content.

According to the present invention there is provided a centrifugal separator for separating solids and recyclable fluids from a fluid mixture which is comprised of a containment chamber and a container rotatably mounted within the containment chamber. The container has a rotation axis, a first end, a second end, a midpoint positioned between the first end and the second end, an exterior, and an interior defined by interior sidewalls which slope from the respective ends away from the rotation axis toward the midpoint thereby defining two back to back truncated conical portions. A first tubular mounting member extends along the rotation axis at the first end and a second tubular mounting member extends along the rotation axis at the second end. A fluid mixture inlet extends through the first tubular mounting member into the interior of the container. A wash fluid inlet extends through the first tubular mounting member into the interior. A strike plate is positioned within the interior transverse to the fluid mixture inlet, such that fluids flowing through the fluid mixture inlet strike the strike plate prior to entering the interior thereby agitating the fluid mixture and promoting separation. Spin vanes extend transverse to the fluid mixture inlet and the wash fluid inlet thereby imparting a rotational force and directing the fluid mixture and wash fluids outwardly from the axis of rotation toward the interior sidewalls. A plurality of spin vanes extend radially inwardly from the interior sidewalls thereby imparting a rotational movement to fluids within the interior. An excess wash fluid outlet extends through the interior sidewall from interior to the exterior. The excess wash fluid outlet has a tubular feed channel with a covered spillway positioned in the interior spaced from the interior sidewall thereby forming an annular weir in which wash fluids accumulate. Excess wash fluids migrate upwardly from below the covered spillway and down the tubular feed channel to the excess wash fluid outlet. The covered spillway has an air passageway thereby preventing siphoning. A recyclable fluid outlet extends through the second end from the interior to the exterior. The recyclable fluid outlet is substantially aligned with the spillway of the excess wash fluid outlet, thereby skimming recyclable fluids which accumulate in a wash fluid/recyclable fluid interface on the surface of the wash fluid. A solids outlet extends through the interior sidewall from the interior to the exterior. The solids outlet is positioned at the midpoint such that solids are washed by the wash fluid down the sloped interior sidewalls of the truncated conical portions toward the solids outlet. Means is provided for rapidly rotating the container about its rotation axis. Upon rapid rotation of the container a wash fluid zone is formed within the confines of the annular weir, with excess wash fluids passing via the spillway to the excess wash fluid outlet. Upon rapid rotation of the container recyclable fluids are forced into a wash fluid/recyclable fluid interface on top of the wash fluid zone by centrifugal force with recyclable fluids and any gases separated from the fluid mixture being skimmed from the wash fluid/recyclable fluid interface through the recyclable fluid outlet. Upon rapid rotation of the container solids are propelled by centrifugal force outwardly toward the interior sidewalls and washed down the slope of the truncated conical portions toward the solids outlet by wash fluids entering the interior through the wash fluid inlet. A shaft is provided having a first end extending through and journalled for rotation within the second tubular rotation member and a second end substantially aligned with the solids outlet. A plurality of arms are secured to and extend from the second end of the shaft to immediately adjacent the solids outlet. The arms have paddle shaped extremities. Means is provided for rotating the shaft at a speed between 50 and 150 rotations per minute faster than the rotation of the container such that upon rotation of the shaft the paddle shaped extremities are brought into communication with any solids accumulated immediately adjacent the solids outlet thereby preventing a build up of solids which could potentially cause a blockage of the solids outlet and propelling solids mixed with wash fluid out the solids outlet. Means are provided to prevent an intermixing of the recyclable fluids and the wash fluids within the containment chamber.

Three phase centrifugal separator as described in copending U.S. patent application Ser. No. 838,570 (now U.S. Pat. No. 5,195,939), was modified for use with fluid mixtures having a high solids content. It was determined that if large orifices were used and a sufficient volume of wash fluid, preferably water, was pumped into the interior of the container solids could be washed out the solids outlet. Although this prevented solids accumulation, it disrupted the wash fluid/recyclable fluid interface. Water passed through the container so rapidly it was difficult to keep sufficient water in to have the separator work properly. When the orifice size was reduced to retain sufficient wash fluid to have a wash fluid/recyclable fluid interface the solids outlet became blocked with accumulations of solids. This blockage was addressed through the addition of the "paddles" which pass across the solids outlet. In handling fluid mixtures with a high solids content the solids outlets became blocked in less than a minute if the paddles ceased functioning. It was also determined that the speed of the paddles was important. If the paddles rotated too fast they created turbulence which disrupted the wash fluid/recyclable fluid interface and stopped the separator from functioning.

Although beneficial effects may be obtained through the use of the centrifugal separator as described, some accumulations of solids is unavoidable as not all solids wash through the solids outlet. The centrifugal separator as described will therefore require cleaning after every 4 to 6 hours of operation depending upon the solids content in the fluid mixture. Even more beneficial results may, therefore, be obtained when the container has a plurality of recyclable fluid outlets spaced parallel to and equidistant from the axis of rotation, and the containment chamber has at least one cleaning aperture axially aligned with at least one of the recyclable fluid outlets such that as the container rotates a jet of washing fluid can be injected through the recyclable fluid outlets into the container thereby washing solids on the interior sidewalls down the sloped truncated conical portions and out the solids outlet.

Formerly, considerable downtime was encountered when the container had to be removed from the containment chamber and disassembled to permit solids accumulations to be shovelled or washed out. With the additional feature as described, the cleaning of the container can be accomplished in less than five minutes by injecting wash fluids through the recyclable fluid inlets as the container is rapidly rotating.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
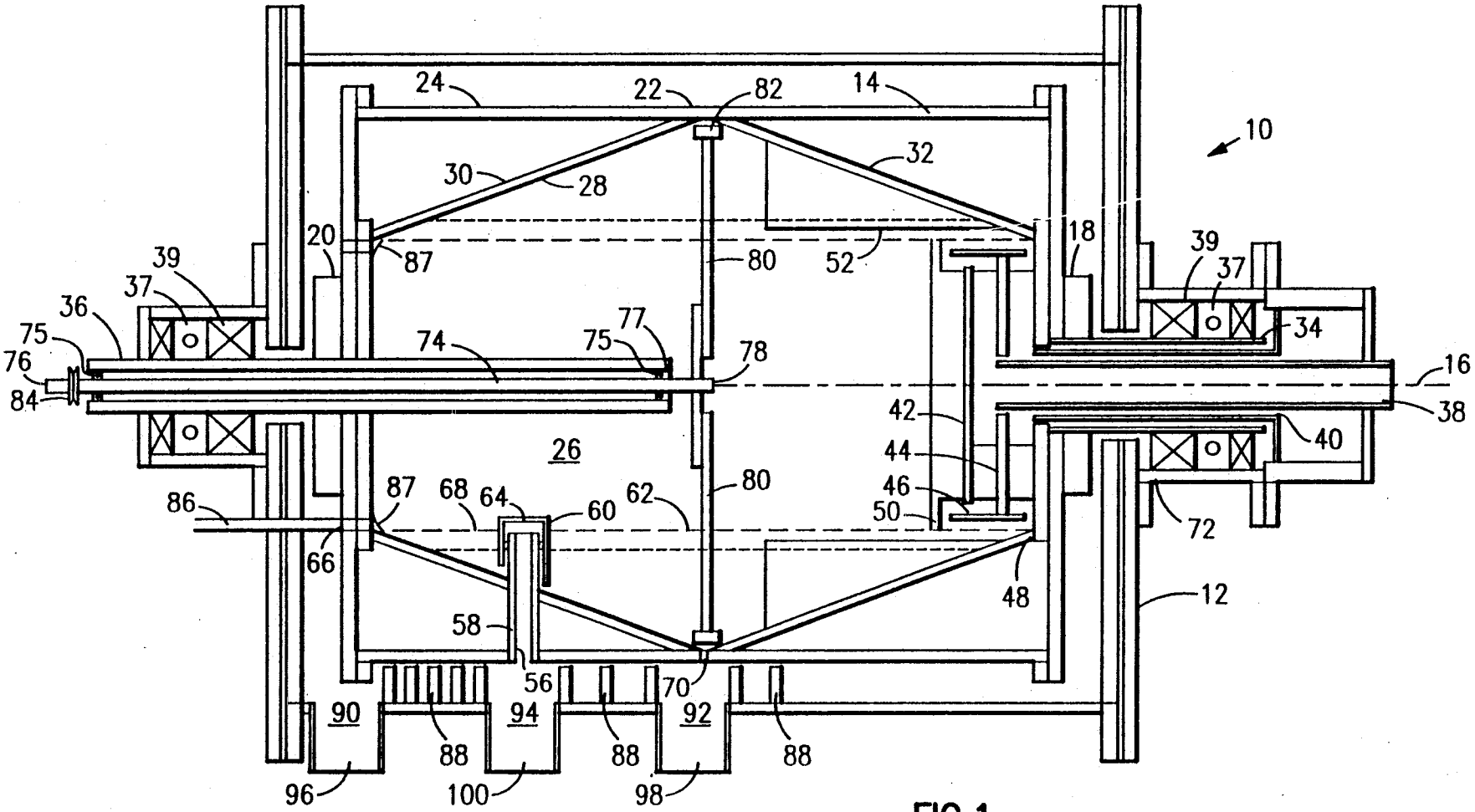
FIG. 1 is a longitudinal section view of a centrifugal separator constructed in accordance with the teachings of the present invention.
Figure 2:
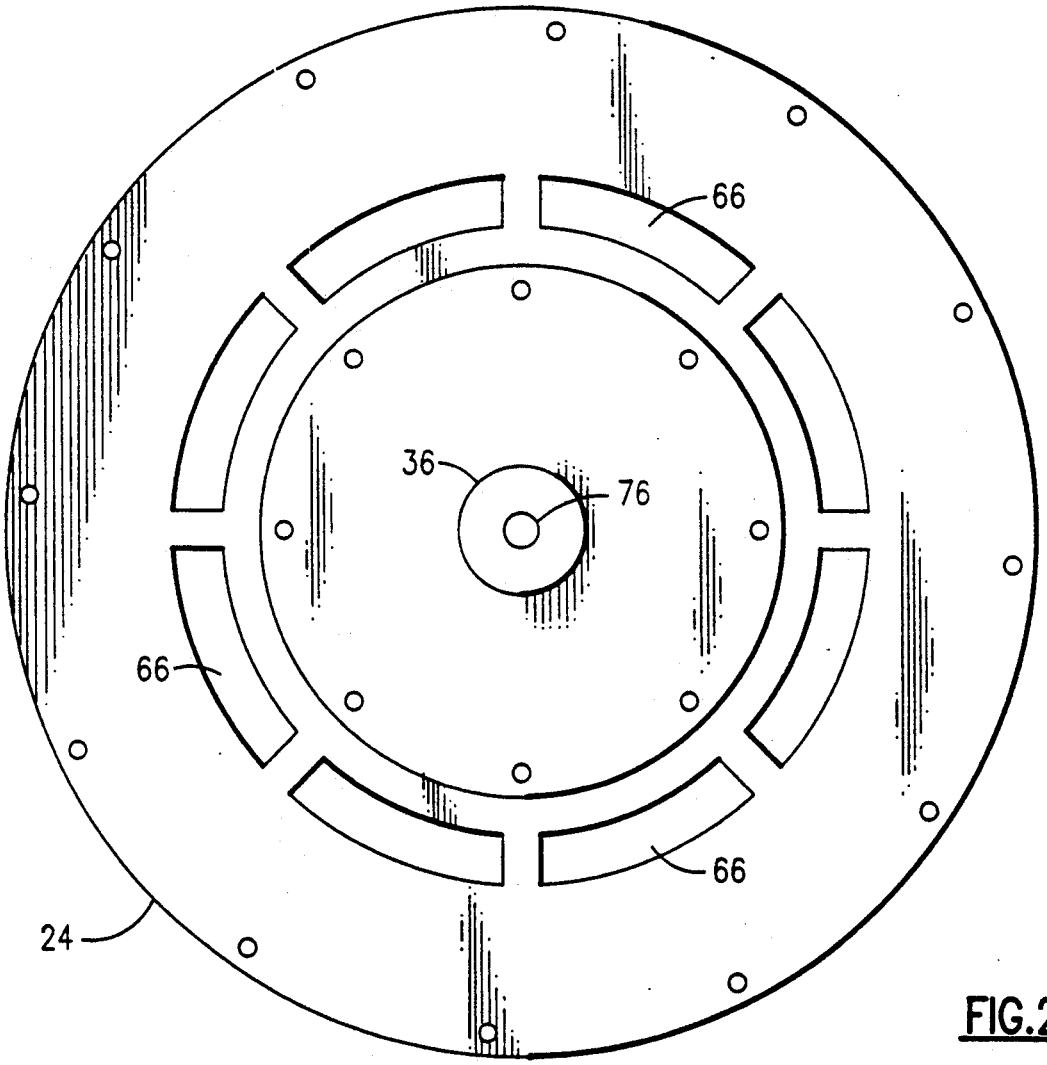
FIG. 2 is a transverse section view taken along section lines 2—2 of FIG. 1.

The preferred embodiment, a centrifugal separator generally identified by reference numeral 10, will now be described with reference to FIGS. 1 and 2.

Centrifugal separator 10 was particularly designed for separating solids and recyclable fluids from a fluid mixture. The proto-type was developed and used in removing water and solids from used oil, although it can be equally useful in other applications. Centrifugal separator 10 consists of a containment chamber 12. There is a wide latitude for construction of containment chamber 12, its purpose is merely to contain the fluids which are separated by centrifugal force during the separation process. A container 14 is rotatably mounted within containment chamber 12. Container 14 must be carefully constructed in order to successfully separate solids from recyclable fluids, the majority of the description which follows will relate to the construction of container 14.

Container 14 has a rotation axis 16, a first end 18, a second end 20, and a midpoint 22 positioned between first end 18 and second end 20. Container 14 has an exterior 24 and an interior 26 defined by interior sidewalls 28 which slope from the ends 18 and 20 away from rotation axis 16 toward midpoint 22 thereby defining two back to back truncated conical portions 30 and 32. A first tubular mounting member 34 extends along rotation axis 16 at first end 18. A second tubular mounting member 36 extends along rotation axis 16 at second end 20. A fluid mixture inlet 38 extends through first tubular mounting member 34 to interior 26. A wash fluid inlet 40 extends through first tubular mounting member 34 to interior 26. It will be apparent from an examination of FIG. 1, that inlets 38 and 40 are concentric with wash fluid inlet 40 "surrounding" fluid mixture inlet 38. A first strike plate 42 is positioned within interior 26 transverse to fluid mixture inlet 38. Fluids flowing through fluid mixture inlet 38 strike first strike plate 42 prior to entering interior 26, thereby agitating the fluid mixture and promoting separation. A second strike plate 44 is positioned within interior 26 transverse to wash fluid inlet 40. Strike plates 42 and 44 have peripheral fluid passages 46 and 48, respectively, through which fluids pass after impacting with the strike plates. Peripheral fluid passages 46 and 48 are substantially aligned which results in a wash fluid stream flowing through wash fluid inlet 40 "crossing" a fluid mixture stream flowing through fluid mixture inlet 38. Inlets 38 and 40 have been specifically designed in such a manner that their function can be reversed. In other words, fluid mixture inlet 38 can be used as a wash fluid inlet and wash fluid inlet 40 can be used as a fluid mixture inlet. It is generally preferred that wash fluid cross the fluid mixture stream, as this enhances separation. However, it was found that when used oils had a high concentrations of detergents and like additives, it was preferable to reverse the inlet functions so as to avoid foaming. Spin vanes 50 are mounted within interior 26 extend transverse to peripheral fluid passages 46 and 48 at the end of recyclable fluid inlet 38 and wash fluid inlet 40. Spin vanes 50 impart a rotational force and direct the fluid mixture and wash fluids outwardly from axis of rotation 16 toward interior sidewalls 28. A second group of spin vanes 52 extend radially inwardly from interior sidewalls 28. Spin vanes 52 impart a rotational movement to fluids within interior 26 adjacent to interior sidewalls 28. An excess wash fluid outlet 56 extends through interior sidewall 28 from interior 26 to exterior 24. Wash fluids outlet 56 has a tubular feed channel 58 with a covered spillway 60 positioned in interior 26. Covered spillway 60 is spaced from interior sidewall 28 and results in the formation of an annular weir 62 in which wash fluids accumulate. Excess wash fluids migrate upwardly from below covered spillway 60 and pass down tubular feed channel 58 to excess wash fluid outlet 56. Covered spillway 60 has an air passageway 64 to prevent siphoning. Referring to FIG. 2, a plurality of recyclable fluid outlets 66 are spaced parallel to and equidistant from axis of rotation 16. Each of recyclable fluid outlets 66 extend through second end 20 from interior 26 to exterior 24. Each of recyclable fluid outlets 66 are substantially aligned with spillway 60 of excess wash fluid outlet 56, thereby skimming recyclable fluids, such as oil, which accumulate in a wash fluid/recyclable fluid interface, generally designated by reference numeral 68, on the surface of wash fluid in annular weir 62. It is preferred that recyclable fluids outlets 66 be in the form of arcuate slots. A solids outlet 70 extends through interior sidewall 28 from interior 26 to exterior 24. Solids outlet 70 is positioned at midpoint 22 such that solids are washed by wash fluid down sloped interior sidewalls 28 of truncated conical portions 30 and 32 toward solids outlet 70. Means must be provided to rotate container 14. A first motor connection 72 is positioned on first tubular mounting member 34 whereby a drive motor (not shown) is connected for rapidly rotating the container about rotation axis 16. It is preferred that container 14 be rotated at between 2000 and 3000 rotations per minute in order to effectively promote separation. First tubular mounting member 34 and second tubular mounting member 36 are supported on bearings 37 to facilitate rotation and have seals 39 to prevent a leakage of fluids from containment chamber 12. A shaft 74 extends through and is journalled for rotation within second tubular rotation member 36. Shaft 74 has a first end 76 and a second end 78. Second end 78 is substantially aligned with solids outlet 70. A plurality of arms 80 are secured to and extend from second end 78 of shaft 74 to immediately adjacent solids outlet 70. Each of arms 80 having paddle shaped extremities 82. Means must be provided for rotating shaft 74. For this purpose a second motor connection 84 is positioned at first end 76 of shaft 74 whereby a motor (not shown) is connected for rapidly rotating shaft 74 at a speed of between 50 and 150 rotations per minute faster than the speed of rotation of container 14. Shaft 74 is supported on bearings 75 at each of ends 76 and 78 to facilitate rotation and has seals 77 at second end 78 to prevent a leakage of fluids from containment chamber 12. Upon rotation of shaft 74, paddle shaped extremities 82 are brought into communication with any solids accumulated immediately adjacent solids outlet 70 thereby preventing a build up of solids which could potentially cause a blockage of solids outlet 70 and propelling solids mixed with wash fluid out solids outlet 70.

There are a number of features of containment chamber 12 which inter-relate to features on container 14. Containment chamber 12 has a cleaning aperture 86 which is axially aligned with one of recyclable fluid outlets 66 such that as container 14 rotates a water jet nozzle (not shown) can be inserted into cleaning aperture 86 and a jet of washing fluid can be injected through recyclable fluid outlets 66 into container 14 thereby washing solids on interior sidewalls 28 down the sloped surface and out solids outlet 70. As previously described, it is preferred that recyclable fluids outlets 66 be in the form of arcuate slots as this facilitates cleaning through cleaning aperture 86. It is preferred that recyclable fluids outlets 66 be equipped with a deflector 87 which serves to direct the jet of washing fluid from the water jet nozzle inserted through cleaning aperture 86 down the sloped surface of interior sidewalls 28. Means must be provided for preventing an intermixing of recyclable fluids and wash fluids/solids within containment chamber 12. A plurality of labrynith seals 88 divide containment chamber 12 into three zones; a recyclable fluid zone 90, a solids zone 92 and a clean wash fluid zone 94. Recyclable fluid zone 90 communicates with recyclable fluid outlet 66. Solids zone 92 communicates with solids outlet 70. Wash fluid zone communicates with excess wash fluid outlet 56. Each of zones 90, 92, and 94 has a corresponding drain, whereby fluid is drained from containment chamber 12. A recyclable fluids drain passageway 96 through containment chamber 12, drains fluids from recyclable fluid zone 90. A solids drain passageway 98 through containment chamber 12, drains solids mixed with wash fluids from solids zone 92. A clean wash fluid drain passageway 100 through containment chamber 12, drains fluids from wash fluid zone 94.

The use and operation of centrifugal separator 10 will now be described with reference to FIGS. 1 and 2. Container 14 is rotated at 2000 to 3000 rotations per minute. Container 14 is primed with a wash fluid, such as water, to create an internal wash fluid zone, as will hereinafter further be described, prior to a fluid mixture to be treated, such as used oil, being introduced. The fluid mixture is pumped in through fluid mixture inlet 38. The wash fluid is concurrently pumped through wash fluid inlet 40. The fluid mixture flowing through fluid mixture inlet 38 strikes strike plate 42 prior to entering interior 26. This agitates the fluid mixture and promotes separation. The fluid mixture then flows into interior 26 via peripheral fluid passages 46. A stream of wash fluid from peripheral fluid passages 48 impinges the flow of fluid mixture flowing from peripheral fluid passages 46, promoting further separation. The fluid steams of fluid mixture and wash fluid encounter spin vanes 50 as they enter interior 26. Spin vanes 50 impart a rotational force and direct the fluid stream of fluid mixture and wash fluid outwardly from axis of rotation 16 toward interior sidewalls 28. The internal wash fluid zone, as previously described, is formed within the confines of annular weir 62. The level of wash fluids remains constant with excess wash fluids migrating upwardly from below covered spillway 60 and down tubular feed channel 58 to excess wash fluid outlet 56. Recyclable fluids are forced into a wash fluid/recyclable fluid interface on top of the internal wash fluid zone by centrifugal force with recyclable fluids and any gases separated from the fluid mixture during the separation process being skimmed from the wash fluid/recyclable fluid interface through recyclable fluid outlet 66. Solids are propelled by centrifugal force outwardly toward interior sidewalls 28 and are washed down the slope of truncated conical portions 30 and 32 toward solids outlet 70 by the continuous flow of wash fluids entering interior 26. The recyclable fluids exiting recyclable fluid outlet 66, solids carried in wash fluids through solids outlet 70, and excess wash fluids flowing from excess wash fluid outlet 56, are contained within containment chamber 12, and then removed via respective drain passageways 96, 98, and 100.

It will be apparent to one skilled in the art that modifications may be made to the illustrated embodiment without departing from the spirit and scope of the invention as defined by the claims.

THE EMBODIMENTS OF THE INVENTION IN WHICH AN EXCLUSIVE PROPERTY OR PRIVILEGE IS CLAIMED ARE DEFINED AS FOLLOWS:

1. A centrifugal separator for separating solids and recyclable fluids from a fluid mixture, comprising:

a. a containment chamber;

b. a container rotatably mounted within the containment chamber, the container having:

i. a rotation axis, a first end, a second end, a midpoint positioned between the first end and the second end, an exterior, an interior defined by interior sidewalls which slope from the respective ends away from the rotation axis toward the midpoint thereby defining two back to back truncated conical portions;

ii. a first tubular mounting member extending along the rotation axis at the first end and a second tubular mounting member extending along the rotation axis at the second end;

iii. a fluid mixture inlet extending through the first tubular mounting member to the interior;

iv. a wash fluid inlet extending through the first tubular mounting member to the interior;

v. a strike plate positioned within the interior transverse to the fluid mixture inlet, such that fluids flowing through the fluid mixture inlet strike the strike plate prior to entering the interior thereby agitating the fluid mixture and promoting separation;

vi. spin vanes extending transverse to the fluid mixture inlet and the wash fluid inlet thereby imparting a rotational force and directing the fluid mixture and wash fluids outwardly from the axis of rotation toward the interior sidewalls;

vii. a plurality of spin vanes extending radially inwardly from the interior sidewalls thereby imparting a rotational movement to fluids within the interior;

viii. an excess wash fluid outlet extending through the interior sidewall from interior to the exterior, the wash fluids outlet having a tubular feed channel with a covered spillway positioned in the interior spaced from the interior sidewall thereby forming an annular weir in which wash fluids accumulate with excess wash fluids migrating upwardly from below the covered spillway and down the tubular feed channel to the excess wash fluid outlet, the covered spillway having an air passageway thereby preventing siphoning;

ix. a recyclable fluid outlet extending through the second end from the interior to the exterior, the recyclable fluid outlet being substantially aligned with the spillway of the excess wash fluid outlet, thereby skimming recyclable fluids which accumulate in a wash fluid/recyclable fluid interface on the surface of the wash fluid;

x. a solids outlet extending through the interior sidewall from the interior to the exterior, the solids outlet being positioned at the midpoint such that solids are washed by the wash fluid down the sloped interior sidewalls of the truncated conical portions toward the solids outlet;

c. means for rapidly rotating the container about its rotation axis such that a wash fluid zone is formed within the confines of the annular weir with excess wash fluids passing via the spillway to the excess wash fluid outlet, recyclable fluids are forced into a wash fluid/recyclable fluid interface on top of the wash fluid zone by centrifugal force with recyclable fluids and any gases separated from the fluid mixture being skimmed from the wash fluid/-recyclable fluid interface through the recyclable fluid outlet, and solids are propelled by centrifugal force outwardly toward the interior sidewalls and washed down the slope of the truncated conical portions toward the solids outlet by wash fluids entering the interior through the wash fluid inlet;

d. a shaft having a first end extending through and journalled for rotation within the second tubular rotation member and a second end substantially aligned with the solids outlet, a plurality of arms being secured to and extending perpendicularly from the second end of the shaft to immediately adjacent the solids outlet, the arms having paddle shaped extremities;

e. means for rotating the shaft at a speed between 50 and 150 rotations per minute faster than the rotation of the container such that upon rotation of the shaft the paddle shaped extremities are brought into communication with any solids accumulated immediately adjacent the solids outlet thereby preventing a build up of solids which could potentially cause a blockage of the solids outlet and propelling solids mixed with wash fluid out the solids outlet; and f. means for preventing an intermixing of recyclable fluids and wash fluids/solids within the containment chamber.

2. The centrifugal separator as defined in claim 1, the container having a plurality of recyclable fluid outlets spaced parallel to and equidistant from the axis of rotation, and the containment chamber having at least one cleaning aperture axially aligned with at least one of the recyclable fluid outlets such that as the container rotates a jet of washing fluid can be injected through the recyclable fluid outlets into the container thereby washing solids on the interior sidewalls down the sloped truncated conical portions and out the solids outlet.

3. A centrifugal separator for separating solids and recyclable fluids from a fluid mixture, comprising:

a. a containment chamber;

b. a container rotatably mounted within the containment chamber, the container having:

i. a rotation axis, a first end, a second end, a midpoint positioned between the first end and the second end, an exterior, an interior defined by interior sidewalls which slope from the respective ends away from the rotation axis toward the midpoint thereby defining two back to back truncated conical portions;

ii. a first tubular mounting member extending along the rotation axis at the first end and a second tubular mounting member extending along the rotation axis at the second end;

iii. a fluid mixture inlet extending through the first tubular mounting member to the interior;

iv. a wash fluid inlet extending through the first tubular mounting member to the interior;

v. a strike plate positioned within the interior transverse to the fluid mixture inlet, such that fluids flowing through the fluid mixture inlet strike the strike plate prior to entering the interior thereby agitating the fluid mixture and promoting separation;

vi. spin vanes extending transverse to the fluid mixture inlet and the wash fluid inlet thereby imparting a rotational force and directing the fluid mixture and wash fluids outwardly from the axis of rotation toward the interior sidewalls;

vii. a plurality of spin vanes extending radially inwardly from the interior sidewalls thereby imparting a rotational movement to fluids within the interior;

viii. an excess wash fluid outlet extending through the interior sidewall from interior to the exterior, the wash fluids outlet having a tubular feed channel with a covered spillway positioned in the interior spaced from the interior sidewall thereby forming an annular weir in which wash fluids accumulate with excess wash fluids migrating upwardly from below the covered spillway and down the tubular feed channel to the excess wash fluid outlet, the covered spillway having an air passageway thereby preventing siphoning;

ix. a plurality of arcuate slotted recyclable fluid outlets spaced parallel to and equidistant from the axis of rotation, each recyclable fluid outlet extending through the second end from the interior to the exterior, the recyclable fluid outlet being substantially aligned with the spillway of the excess wash fluid outlet, thereby skimming recyclable fluids which accumulate in a wash fluid/recyclable fluid interface on the surface of the wash fluid;

x. a solids outlet extending through the interior sidewall from the interior to the exterior, the solids outlet being positioned at the midpoint such that solids are washed by the wash fluid down the sloped interior sidewalls of the truncated conical portions toward the solids outlet;

c. a first motor connection on the first tubular mounting member whereby a drive motor is connected for rapidly rotating the container about its rotation axis such that a wash fluid zone is formed within the confines of the annular weir with excess wash fluids passing via the spillway to the excess wash fluid outlet, recyclable fluids are forced into a wash fluid/recyclable fluid interface on top of the wash fluid zone by centrifugal force with recyclable fluids and any gases separated from the fluid mixture being skimmed from the wash fluid/recyclable fluid interface through the recyclable fluid outlet, and solids are propelled by centrifugal force outwardly toward the interior sidewalls and washed down the slope of the truncated conical portions toward the solids outlet by wash fluids entering the interior through the wash fluid inlet;

d. a shaft having a first end extending through and journalled for rotation within the second tubular rotation member and a second end substantially aligned with the solids outlet, a plurality of arms being secured to and extending perpendicularly from the second end of the shaft to immediately adjacent the solids outlet, the arms having paddle shaped extremities;

e. a second motor connection at the first end of the shaft whereby a motor is connected for rapidly rotating the shaft at a speed between 50 and 150 rotations per minute faster than the rotation of the container such that upon rotation of the shaft the paddle shaped extremities are brought into communication with any solids accumulated immediately adjacent the solids outlet thereby preventing a build up of solids which could potentially cause a blockage of the solids outlet and propelling solids mixed with wash fluid out the solids outlet;

f. a plurality of seals dividing the containment chamber into at least two zones, a recyclable fluid zone communicating with the recyclable fluid outlet and a wash fluid/solids zone communicating with the solids outlet and the excess wash fluid outlet;

g. a recyclable fluids drain passageway in the containment chamber communicating with the recyclable fluid zone;

h. a wash fluid/solids drain passageway in the containment chamber communicating with the wash fluid/solids zone; and i. a cleaning aperture in the containment chamber axially aligned with at least one of the recyclable fluid outlets such that as the container rotates a jet of washing fluid can be injected through the recyclable fluid outlets into the container thereby washing solids on the interior sidewalls down the sloped truncated conical portions and out the solids outlet.

* * * * *